United States Patent [19]

Nakagaki

[11] Patent Number: 4,994,129

[45] Date of Patent: Feb. 19, 1991

[54] METHOD AND APPARATUS FOR TEMPORARILY COVERING OPENINGS OF CONTAINERS

[75] Inventor: Keisuke Nakagaki, Toukai, Japan

[73] Assignee: Nittetsu Steel Drum Co., Ltd., Tokyo, Japan

[21] Appl. No.: 336,902

[22] Filed: Apr. 12, 1989

[51] Int. Cl.[5] ..... B32B 31/12

[52] U.S. Cl. ..... 156/69; 53/485; 156/249; 156/351; 156/364; 156/542

[58] Field of Search ..... 53/485; 156/69, 249, 156/541, 542, 351, 363, 364

[56] References Cited

U.S. PATENT DOCUMENTS

| | | | |
|---|---|---|---|
| 3,177,106 | 4/1965 | Seefluth et al. | 53/485 X |
| 3,383,256 | 5/1968 | Carbone | 156/69 |
| 3,672,113 | 6/1972 | Andra | 53/485 X |
| 4,514,248 | 4/1985 | Cummings | 156/69 X |
| 4,762,579 | 8/1988 | Shimizu et al. | 156/69 |
| 4,771,903 | 9/1988 | Levene et al. | 156/69 X |
| 4,835,943 | 6/1989 | Mueller | 53/485 |

*Primary Examiner*—Robert A. Dawson

*Attorney, Agent, or Firm*—Wenderoth, Lind & Ponack

[57] ABSTRACT

A method and apparatus to temporarily cover an opening of a container to prevent the entry of foreign matters during a process in which a large number of containers are handled. A temporary cover has a sticky surface on one side that is large enough to cover the opening of the container. The temporary cover is positioned near the opening of the container, with the sticky surface directed to face the opening. Then, the temporary cover is lightly pressed against the end of the opening so that the cover adheres in position. After a given operation has been completed, the temporary cover is removed from the opening of the container.

23 Claims, 7 Drawing Sheets

METHOD AND APPARATUS FOR TEMPORARILY COVERING OPENINGS OF CONTAINERS

BACKGROUND OF THE INVENTION

1. Field of the Invention

This invention relates to a method and apparatus for temporarily covering openings, such as spouts and mouths, of bottles, cans and other containers.

2. Description of the Prior Art

In a series of processes handling many containers, sometimes there arises a need to temporarily close an opening or openings of each container. In the manufacturing of drum containers, for example, a temporary cap is fitted over the spout of each drum when the exterior of the drum is to be painted so that no paint gets inside. Other examples can be found in the food and medicine industries, too. When washed bottles are sent to the next process or temporarily put aside, the mouth of each bottle is temporarily covered so that no dust, waterdrops or other foreign matters gets inside. Such temporary covers are detached on completion of painting or before the contents are filled.

Caps, cap-like covers and elastic stoppers having an elastic portion adapted to fit in or over the opening are extensively used as temporary covers.

Because of the design necessary to fit the elastic portion in or over the opening, such conventional temporary covers must be exactly positioned over the opening to be covered. Attaching and detaching such temporary covers requires a considerable amount of labor. The need to pay close attention and the large amount of labor required has made it difficult to continue manual attaching and detaching work for long periods of time. Automatic attaching and detaching necessitate a high-precision positioner and a high-power actuator. The prior art automated systems have been complex, bulky and expensive.

SUMMARY OF THE INVENTION

The object of this invention is to provide a method and apparatus for temporarily covering container openings with a temporary cover that feature the ease the temporary cover can be positioned, attached and detached easily.

The temporary opening covering method of this invention sticks a temporary cover having an sticky surface to the end of an opening of a container so that the opening is covered thereby.

Optimum temporary covers are label-like in shape and made of paper. But they may be made of plastics or sheet metal, too. On the sticky surface of the cover is applied an adhesive of the type used with detachable labels. This sticky surface permits the cover to be easily attached to and detached from the opening of a container. To facilitate attaching and detaching, the temporary cover should preferably be somewhat larger than the opening of the container.

When the sticky surface carrying an adhesive is lightly pressed against the end of an opening, the temporary cover sticks thereto. However, the temporary cover is adapted to readily comes off from the end of the opening when pulled.

An apparatus for temporarily covering an opening of a container according to this invention comprises means for conveying containers, positioning means provided midway in the conveying means to stop a container at a point where an opening thereof is to temporarily be closed, means to feed a temporary cover, which has a sticky surface and is large enough to cover the opening of the container, to a temporary covering point close to the opening of the container with the stick side directed toward the opening of the container, and means provided adjacent to the cover feeding means to lightly press the temporary cover against the end of the opening of the container so that the temporary cover sticks to the end of the opening.

This invention permits fitting a temporary cover to the end of an opening of a container by simply pressing the sticky side of the cover against the end of the opening. The temporary cover comes off easily from the end of the opening when it is pulled lightly. Therefore, no great force is required for the attachment and detachment of a temporary cover. Exact positioning of the temporary cover relative to the opening of the container is unnecessary, too. The temporary cover being somewhat larger than the opening of the container makes positioning easier. All this permits a simpler and less costly automated apparatus to be designed for attaching and detaching a temporary cover.

DESCRIPTION OF THE PREFERRED EMBODIMENTS

Preferred embodiments to be described herein are for automatically attaching a temporary cover to a spout of a drum before the drum is painted. In the painting process of oil-drums, the spout of the drum is often closed with a temporary cover so that no paint gets inside therethrough. The mechanism and operation of an automatic temporary cover fitter will be described hereunder. Removal of the attached temporary cover will also be discussed.

I. Temporary Cover Attaching Process (1) Rough Positioning of Drum

An automatic temporary coverer is provided midway in a drum manufacturing line.

Figure 1:
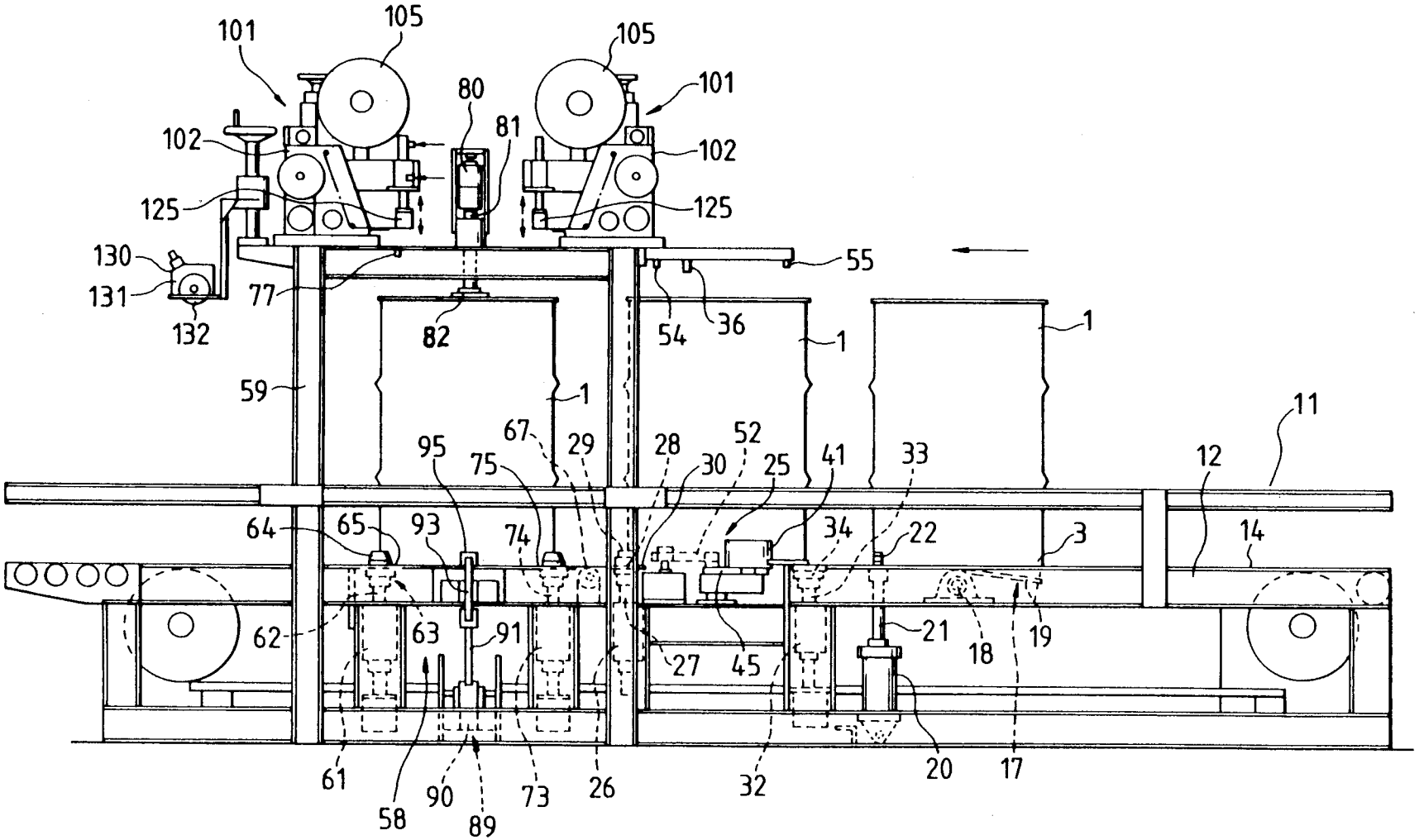
FIG. 1 is a side elevation showing a preferred embodiment of an automatic temporary covering apparatus.
Figure 2:
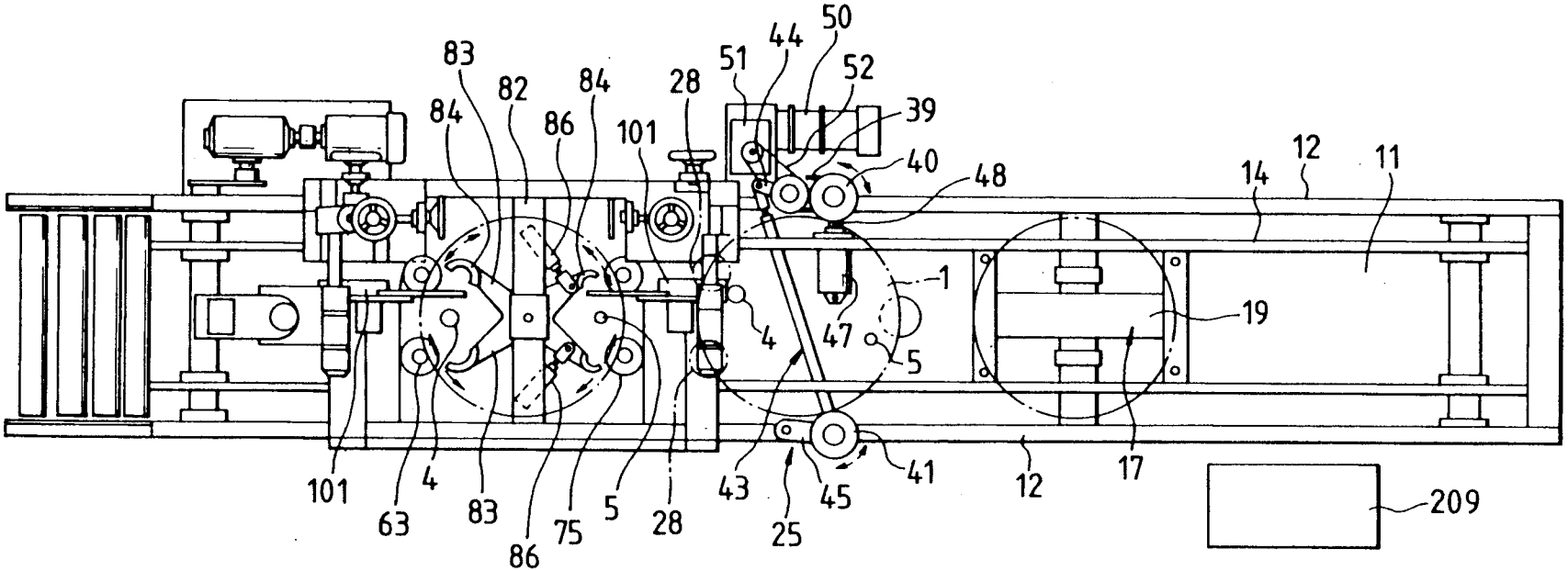
FIG. 2 and FIG. 3 are a plan view and a front view of the apparatus shown in FIG. 1.

As shown in FIGS. 1 and 2, a pair of side frames 12 extend along a drum manufacturing line 11. A chain conveyor 14, which is driven by a gearmotor 15 (see FIG. 3), is provided along the side frames 12. The chain conveyor 14 carries forward a drum 1 that is mounted thereon in the upright position. The illustrated manufacturing line 11 is preceded by a seaming unit (not shown) and followed by a painting unit (not shown).

The manufacturing line 11 has a spacer feed stopper 17 equipped with a stopper arm 19 that is supported between the side frames 12 by means of a bearing 18. The forward end of the stopper arm 19 is connected to the top end of the rod 21 of an air cylinder 20. The stopper arm 19 moves up and down about a horizontal axis as the air cylinder 20 reciprocates. Projections 22 are provided near both sides of the forward end of the stopper arm 19. The projections 22 stick out above the level of the chain conveyor 14 as the stopper arm 19 turns. The protruding projections 22 come in contact with the forward edge of a seamed portion 3 of the drum 1 to stop the forward travel thereof over the chain conveyor 14. The spacer feed stopper 17 is timed to the pace at which drums 1 are made.

Figure 4:
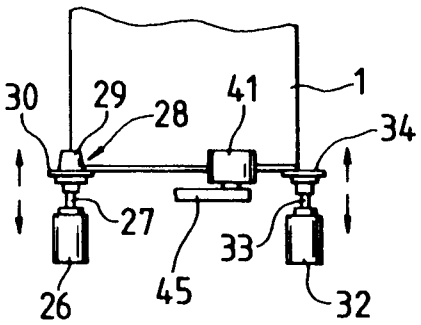
FIG. 4 is a front view of a rough drum positioner.

A rough positioner 25 is provided downstream of the spacer feed stopper 17. The rough positioner 25 has a pair of air cylinders 26 spaced away from each other on both sides of the manufacturing line 11. The rod 27 of each air cylinder 26 is connected to a free roll 28 that doubles as a stopper. The free roll 28 doubling as the stopper comprises a stopper segment 29 and a drum supporting segment 30. The drum supporting segment 30 is rotatable with respect to the rod 27. The supporting segment 30 of the free roll 28 is adapted to support the front of the drum 1 as shown in FIG. 4. A pair of air cylinders 32 spaced breadthwise away from each other are provided behind (upstream of) the free roll 28 doubling as the stopper. The rod 33 of each air cylinder 32 is connected to a drum supporting free roll 34. The drum supporting free roll 34 is adapted to rise to support the back of the drum 1. Signals sent from an optical drum sensor 36 synchronously actuate the two pairs of air cylinders 26 and 32, whereby the free rolls 28 and 34 raise the drum 1 slightly above the chain conveyor 14.

A base 39, which is rotatable about a vertical axis, is attached to the side frame 12. A drum drive roll 40 rotatable about a vertical axis is attached to the base 39. Also, a driven roll 41 is connected to the base 39 through a link mechanism 43. While a link 44 of the link mechanism 43 is connected to the base 39, another link 45 is connected to the side frame 12. The rod 48 of an air cylinder 47 is also coupled to the base 39. While the air cylinder 47 pulls the base 39 toward the chain conveyor 14, the link mechanism 43 causes the rolls 40 and 41 to hold the drum 1 therebetween. A motor 50 with a brake and a speed reducer 51 are attached to the side frame 12. The speed reducer 51 and the drum drive roll 40 are interlocked by means of a belt transmission 52. The motor 50 with the brake drives the drum drive roll 40 which, in turn, turns the drum 1. Signals sent from an optical large spout sensor 54 and an optical small spout sensor 55 installed above the chain conveyor 14 control the operation of the motor 50 with the brake.

A drum 1 carried forward in the upright position on the chain conveyor 14 up to the rough positioner stops on coming in contact with the free roll 28 doubling as the stopper that has been raised previously by the action of the air cylinder 26. The drum supporting segment 30 of the free roll 28 doubling as the stopper supports the front of the drum 1 that has come to a standstill as shown in FIG. 4. At the same time, signals from the drum sensor 36 actuate the air cylinder 32 which, in turn, raises the drum supporting free roll 34 to the position. to support the back of the drum 1. Then, the air cylinder 47 operates to close the drum drive roll 40 and the driven roll 41 interlocked by the link mechanism 43, whereupon the rolls 40 and 41 hold the drum 1 therebetween. The drum 1 turns as the drive roll 40 is rotated by the motor 50 with the brake through the speed reducer 51. When the large spout sensor 54 detects a large spout 4 and the small spout sensor 55 detects a small spout 5 (when the drum 1 has only a small spout), the brake on the motor 50 works to stop the rotation of the drum 1.

Next, the air cylinder 47 operates to move the drum drive roll 40 and the driven roll 41 away from the drum, with the air cylinders 26 and 32 functioning to lower the free roll 28 doubling as the stopper and the drum supporting free roll 34. The chain conveyor 14 then carries forward the drum 1 thus placed thereon to a fine positioner.

(2) Fine Positioning of Drum

Figure 5A:
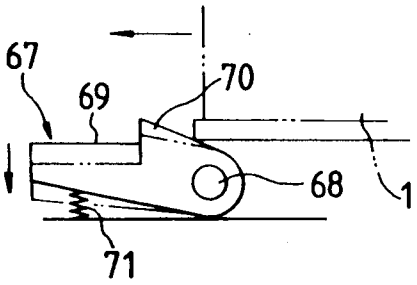
FIGS. 5(*a*) and (*b*) are side elevations illustrating the operation of a stopper for preventing rebounding.
Figure 5B:
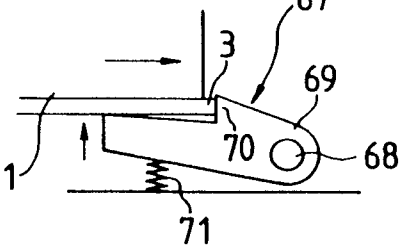

A fine positioner 58 is installed in a housing 59 provided next to the rough positioner 25 on the downstream side thereof. A pair of air cylinders 61 spaced breadthwise away from each other are provided in the lower exit side of the housing 59. The rod 62 of each air cylinder 61 is connected to a free roll 63 doubling as a stopper. The free roll 63 doubling as the stopper comprises a stopper segment 64 and a drum supporting segment 65. The drum supporting segment 65 is rotatable with respect to the rod 62. On the entry side of the housing 59 is provided a stopper 67 to prevent rebounding. The rebound preventing stopper 67 has a pawl 69 rotatable about a pin 68 as shown in FIGS. 5(*a*) and (*b*). The pawl 69 has a shoulder 70 and is urged upward by s spring 71.

An air cylinder 73 is installed next to the rebound preventing stopper 67. The rod 74 of the air cylinder 73 is connected to a drum supporting free roll 75. An optical drum sensor 77 is attached to the top of the housing 59. Signals from the drum sensor 77 actuate the air cylinder 73 to raise the drum supporting free roll 75.

An air cylinder 80 is mounted on the housing 59. To the lower end of the rod 81 of the air cylinder 80 is connected a horizontal elevating member 82 that extends perpendicular to the manufacturing line 11. A pair of positioning arms 83 and air cylinders 86 are attached to the elevating member 82 (see FIG. 2). The positioning arms 83 are crossed, with jaws 84 provide at both ends of each arm to hold the spouts 4 and 5 therebetween. The rod 87 of the air cylinder 86 is connected to each positioning arm 83. The air cylinder 86 opens and closes the positioning arms 83 about their point of intersection. The arm lowering air cylinder 80 has two strokes. A shorter stroke is for ordinary drums and a longer one is for open drums.

Figure 6:
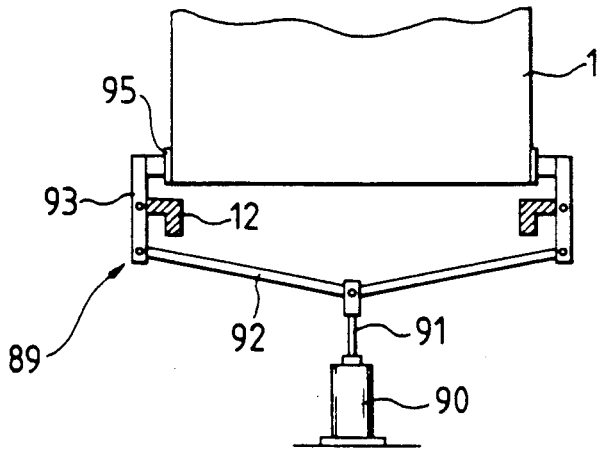
FIG. 6 is a front view of a brake for preventing displacement.

A displacement preventing unit 89 is provided between the free roll 63 doubling as the stopper and the drum supporting free roll 75. The displacement preventing unit 89 has an air cylinder 90, with a pair of levers 92 being pin-connected to the rod 91 thereof, as shown in FIG. 6. A rotatable arm 93 is attached to each side frame 12. While one end of each arm 93 is pin-connected to the tip of the lever 92, the other end thereof is fastened to a holder 95. Because the lever 92 and the arm 93 make up a link mechanism, the holders 95 open and close as the air cylinder 90 operates. When closed, the holders 95 hold a drum 1 therebetween.

A drum 1 delivered from the rough positioner stops on coming in contact with the free roll 63 doubling as the stopper that has been lifted in advance by the air cylinder 61, whereupon the rebound preventing stopper 67 functions. To be more specific, the drum 1 carried forward by the chain conveyor 14 depresses, with its own weight, and passes over the pawl 69 as shown in FIG. 5(*a*). When the drum 1 has passed over the pawl 69, the spring 71 pushes up the pawl 69 as shown in FIG. 5(*b*). Then, the shoulder 70 receives the seamed portion 3 of the drum 1 bouncing back from the free roll 63 doubling as the stopper, thereby bringing the drum 1 to a standstill. When the drum 1 stops, signals from the drum sensor 77 actuate the air cylinder 61 and 73 to raise the free roll 63 doubling as the stopper and the drum supporting roll 75. Then, the drum 1 is held slightly above the chain conveyor 14 so as to be rotated about the center axis thereof by the rolls 63 and 75.

Next, the air cylinder 80 works to lower the positioning arms 83 which are then closed by the air cylinders 86 so that the jaws 84 hold the spouts 4 and 5 therebetween. Consequently, the drum 1 is somewhat turned about the center axis thereof and positioned so that the spouts 4 and 5 lie in the direction in which the drum travels forward. At the same time, the air cylinder 90 actuates the holders 95 of the displacement preventing unit to hold the drum 1 therebetween.

Then, the positioning arms 83 open and rise to the waiting position, with the holders 95 of the displacement preventing unit 89 holding the drum 1 therebetween.

(3) Attachment of Temporary Cover

Figure 7:
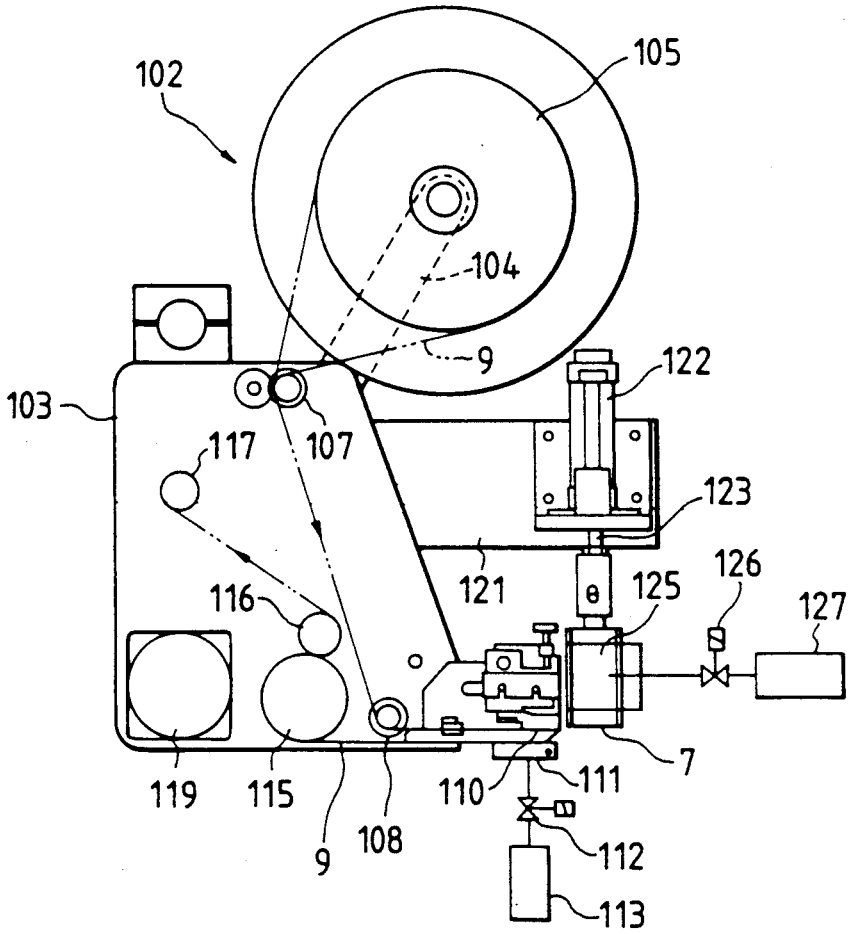
FIG. 7 is a side elevation of a labeling machine.

A temporary cover fitter 101 has two labeling machines 102 mounted on top of the housing 59. FIG. 7 shows a labeling machine 102 that is of the ordinary type widely used for the attachment of labels. A reel 105 is attached to the base 103 of the labeling machine 102 by means of an arm 104. The reel 105 carries a coil of paper strip 9 on which temporary covers 7 are removably attached at given intervals. A guide roll 107 is provided near the top of the base 103, while another guide roll 108 near the bottom thereof. A peel plate 110 and an air assist 111 are provided in front of the guide roll 108. An air compressor 113 is connected to the air assist 111 through a solenoid valve 112. The peel plate 110 strips a temporary cover from the paper strip. The air assist 111 blows air onto the temporary cover to assist in the stripping action. Behind the guide roll 108 near the bottom of the base 103 are provided a drive roll 115 and an auxiliary roll 116 held in contact therewith. A coiling roll 117 above the drive roll 115 is also attached to the base 103. The drive roll 115 and coiling roll 117 are driven by a motor combined with a clutch brake. An air cylinder 122 in an upright position is attached to a bracket 121 extending forward from the base 103. A vacuum grid 125 is connected to the lower end of the air cylinder 122. Connected to a vacuum pump 127 through a solenoid valve 126, the vacuum grid 125 exerts a sucking force to draw the stripped temporary cover 7.

Figure 8:
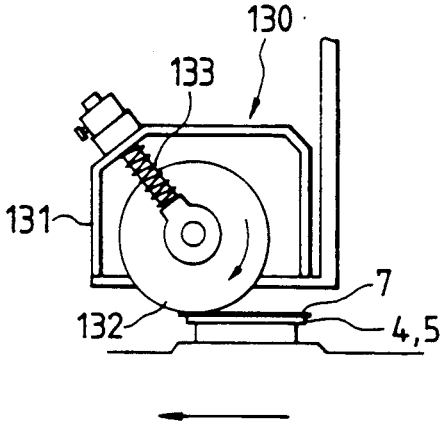
FIG. 8 is a side elevation of a light depressor.

A light depressor 130 is provided on the exit side of the housing 59. The light depressor 130 has a press roll 132 rotatably attached to a frame 131, as shown in FIG. 8. A spring 133 urges the press roll 132 downward to press the temporary covers 7 against the end of the spouts 4 and When fine positioning is completed as described before, each of the two labeling machines 102 works to attach one circular temporary cover 7 of paper to the end of the large spout 4 and the small spout 5, respectively, the covers 7 being slightly larger than the two spouts. Applied with an adhesive, one side of each of the label-like temporary covers 7 is sticky.

The temporary covers 7 put on the paper strip 9 are fed from the reel 105 to the peel plate 110 through the guide rolls 107 and 108. Then, the air cylinder 122 actuates the vacuum grid 125 to peel off one temporary cover 7 after another from the paper strip 9. The peeled temporary covers 7 are then lightly placed on the end of the spouts 4 and 5.

Next, the vacuum grid 125 ascends, the holders 95 of the displacement preventing unit 89 open, and the free roll 63 doubling as the stopper and the drum supporting free roll 75 descend. A drum 1 is then placed back on the chain conveyor 14 that carries the drum 1 forward.

The drum 1 carrying the temporary covers on the spouts 4 and 5 presses under the light depressor 130. The spring 133 urges the press roll 132 to lightly press the temporary covers 7 against the end of the spouts 4 and 5 to cause the temporary covers 7 to adhere thereto.

Figure 9A:
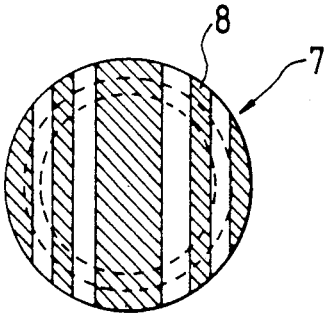
FIG. 9(*a*) is a bottom view of a temporary cover and FIG. 9(*b*) shows a clearance left between the temporary cover and a spout of a container.
Figure 9B:
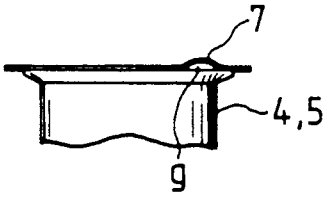

The adhesive on the sticky side 8 of the temporary cover 7 is applied in stripes as shown in FIG. 9(*a*). If the adhesive were applied over the whole surface of the sticky side, the temporary cover 7 would tightly seal the drum 1. As the drum temperature drops from the point at which a temporary cover is affixed (while traveling from the labeling machines to a drying oven through a painting unit), a vacuum produced inside the drum pulls the cover 7 to inside the spout. A similar phenomenon occurs also when the drum has left the drying oven. With a cover on which the adhesive is applied in stripes as described previously, however, non-adhesive portions thereof come off easily when the vacuum draws the cover inside, thereby leaving a clearance g between the temporary cover 7 and the spouts 4 and 5, as shown in FIG. 9(*b*). Consequently, air is drawn inside to keep the temporary cover 7 in position on the outside of the spout.

II Temporary Cover Removing Process (1) Rough Positioning of Drum

Figure 10:
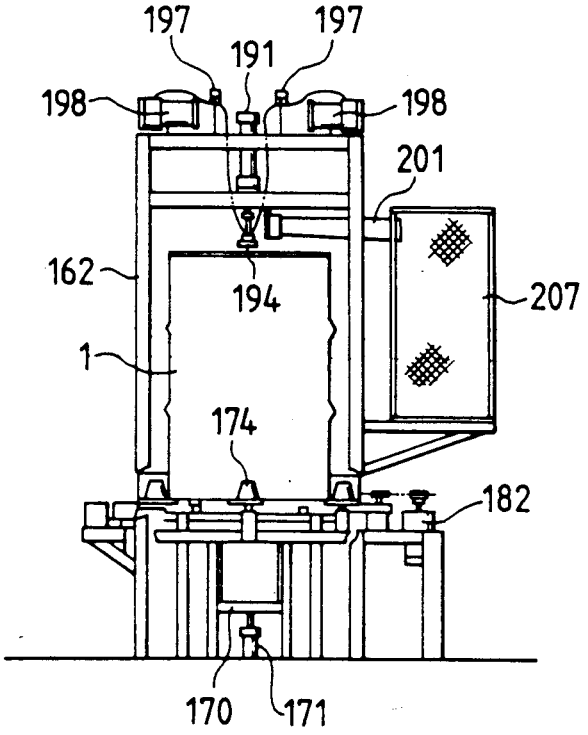
FIG. 10 is a front view showing a preferred embodiment of an automatic temporary cover remover.
Figure 11:
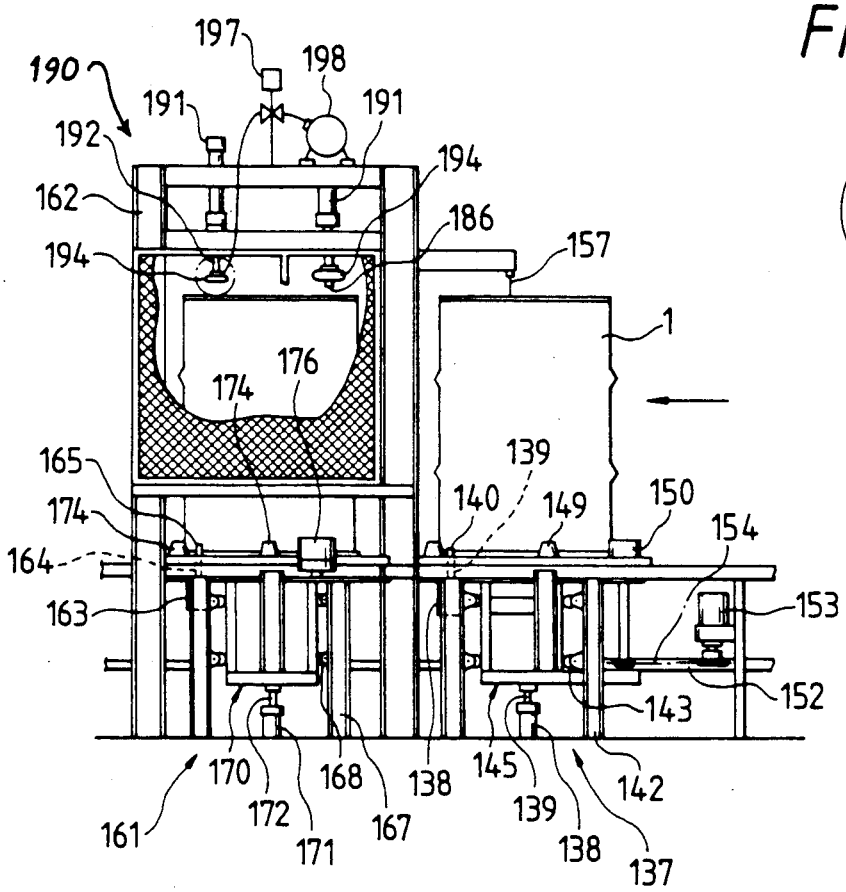
FIGS. 11 and 12 are a side elevation and a plan view of the apparatus shown in FIG. 10.
Figure 12:
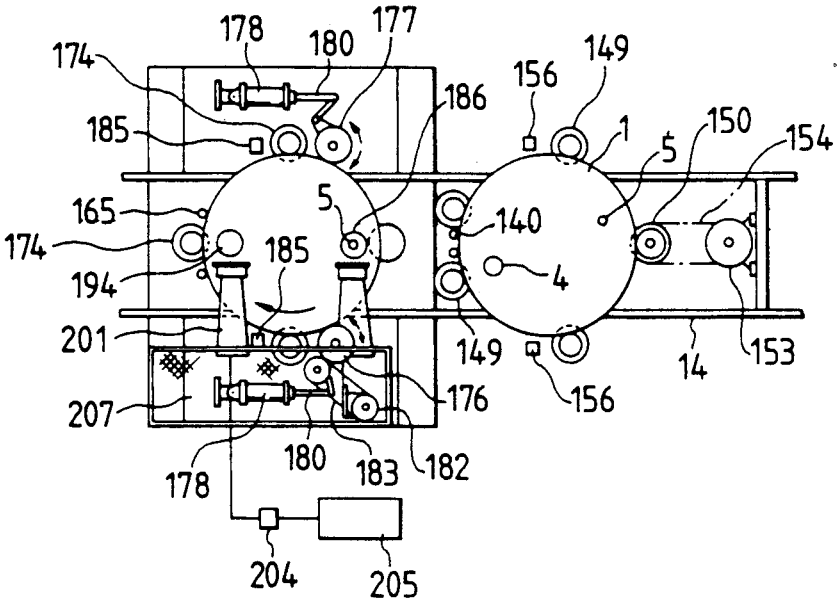
Figure 13:
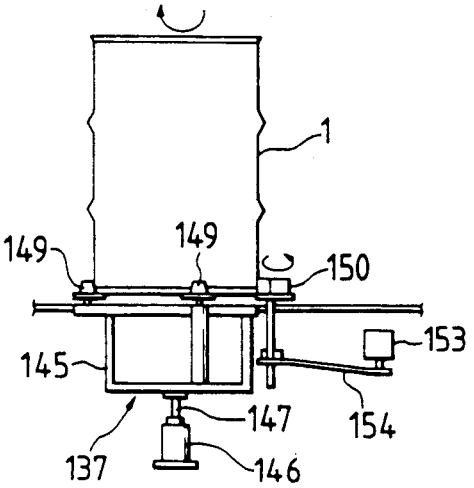
FIG. 13 is a side elevation of a drum positioner.

An automatic temporary cover removing device is shown in FIGS. 10 to 12.

The automatic temporary cover removing device is provided downstream of the painting unit on the drum manufacturing line 11.

A rough positioner 137 is provided midway on the chain conveyor 14. The rough positioner 137 is equipped with an air cylinder 138, with a stopper 140 connected to the rod 139 of the air cylinder 138. The rough positioner 137 is also equipped with a lifter 145 that moves up and down guided by guide rolls 143 mounted on a support 142. The rod 147 of an air cylinder 146 is connected to the filter 145. The lifter 145 supports a drum supporting free roll 149 and a drum drive roll 150. A motor 153 equipped with a brake and supported by a bracket 152 drives the drum drive roll 150 through a chain transmission 154 as shown in FIG.

13. An optical drum sensor 156 and a touch-type spout sensor 157 are respectively provided on each side and above the chain conveyor 14.

In the rough positioner 137 of the type just described, a drum 1, which is carried in the upright position over the chain conveyor 14, stops on coming in contact with the stopper 140 that has been previously raised by the action of the air cylinder 138. The spouts 4 and 5 on each arriving drum are oriented randomly.

Signals from the drum sensor 156 actuate the air cylinder 146 to raise the lifter 145. When the lifter 145 has risen into position, the motor 153 equipped with a brake works to turn the drum 1. When the spout sensor 157 detects the large spout 4, the brake on the motor 153 functions to stop and roughly bring into position the rotating drum 1. Then, the stopper 140 and lifter 145 descend, with the chain conveyor 14 carrying the drum 1 forward to a fine positioner 161.

(2) Fine Positioning of Drum

A fine positioner 161 is installed in a housing 162 provided next to the rough positioner on the downstream side thereof. An air cylinder 163 is provided in the lower part of the housing 162, with a stopper 165 connected to the rod 164 of the air cylinder 163. The fine positioner 161 is also equipped with a lifter 170 that moves up and down guided by guide rolls 168 mounted on a support 167. The rod 172 of an air cylinder 171 is connected to the lifter 170. A drum supporting free roll 174 is attached to the lifter 170. A drum drive roll 176 and a driven roll 177 are provided next to the lifter 170. To the drum drive roll 176 and driven roll 177 is connected an air cylinder 178 through a link mechanism 180. A motor 182 equipped with a brake is connected to the drum drive roll 176 through a chain transmission 183. An optical drum sensor 185 is provided on each side of the chain conveyor 14, with a spout sensor 186 installed in the upper portion of the housing 162.

In the fine positioner 161 just described, a drum 1 from the rough positioner 137 stops on coming in contact with the stopper 165 that has been previously raised by the air cylinder 163. Signals from the drum sensors 185 actuate the air cylinder 171 to raise the lifter 170, whereby the drum 1 is lifted above the chain conveyor 14. Then, the air cylinder 178, through the link mechanism 180, closes the drum drive roll 176 and driven roll 177 so that the drum 1 is held therebetween. The motor 182 with a brake turns the drum 1. When the spout sensor 186 detects the small spout 5, the brake on the motor 182 functions to stop the drum 1 at the desired point (approximately directly below the sucking point). To stop the large spout 4 at the desired point, the drum 1, which was turned at a speed of 60 rpm in the rough positioner, is now turned at 26 rpm.

(3) Removal of Temporary Cover

Figure 14:
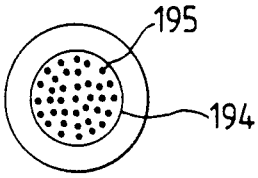
FIG. 14 is a bottom view of a sucker.

A temporary cover remover 190 has a pair of air cylinders 191 mounted on top of the housing 162. The air cylinders 191 are positioned so that the large spout 4 and small spout 5 will come therebelow. A sucking disc 194 is attached to the lower end of the roll 192 of each air cylinder 191, with a vacuum pump 198 connected to the sucking disc 194 through a solenoid valve 197. The vacuum pump 198 is at all times in operation. The sucking disc 194 has a large number of small holes 195, as shown in FIG. 14, through which air is sucked in.

Figure 15:
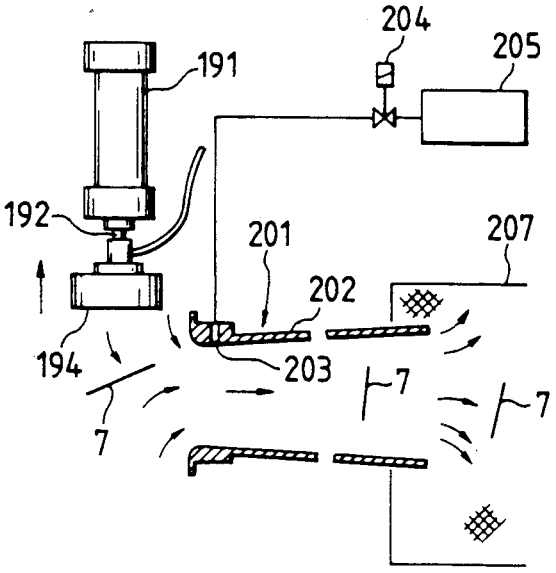
FIG. 15 is a partially cross-sectional plan view of a temporary cover suction unit.

The temporary cover remover 190 also has a temporary cover sucker 201 equipped with a pair of diffusers 202. The forward end of each diffuser 202 is positioned approximately diagonally below the sucking disc 194. A nozzle 203 is provided near the forward end of the diffuser 202 as shown in FIG. 15. The nozzle 203 is connected to an air compressor 205 through a solenoid valve 204. The rear end of the diffuser 202 opens into a temporary cover recovery basket 207. When the solenoid valve 204 opens, a high-velocity stream of air flows through the nozzle 203 into the diffuser 202 to establish a vacuum near the forward end of the diffuser 202. Consequently, the atmosphere near the forward end of the diffuser 202 flows inside to draw in the temporary covers 7 covering the large spout 4 and small spout 5 which are then sent into the recovery basket 207.

When the air cylinder 191 lowers the sucking discs 194 toward the large spout 4 and small spout 5 that are positioned directly therebelow as described before, the solenoid valve 197 opens to cause each sucking disc 194 to suck and ascend with a temporary cover 7. When the sucking disc 194 with the sucking cover 7 has risen to the upper limit, the solenoid valve 197 closes and the solenoid valve 204 opens. When the solenoid valve 197 closes, the sucking disc 194 loses the sucking force and drops the temporary cover 7. If the sucking disc 194 fails to drop the temporary cover 7, air is sent into the sucking disc 194. The temporary cover sucker 201 sucks in the falling temporary cover 7, which is then sent into the recovery basket 207. Then, the stopper 165 and lifter 170 descend to move the drum 1 forward.

Figure 3:
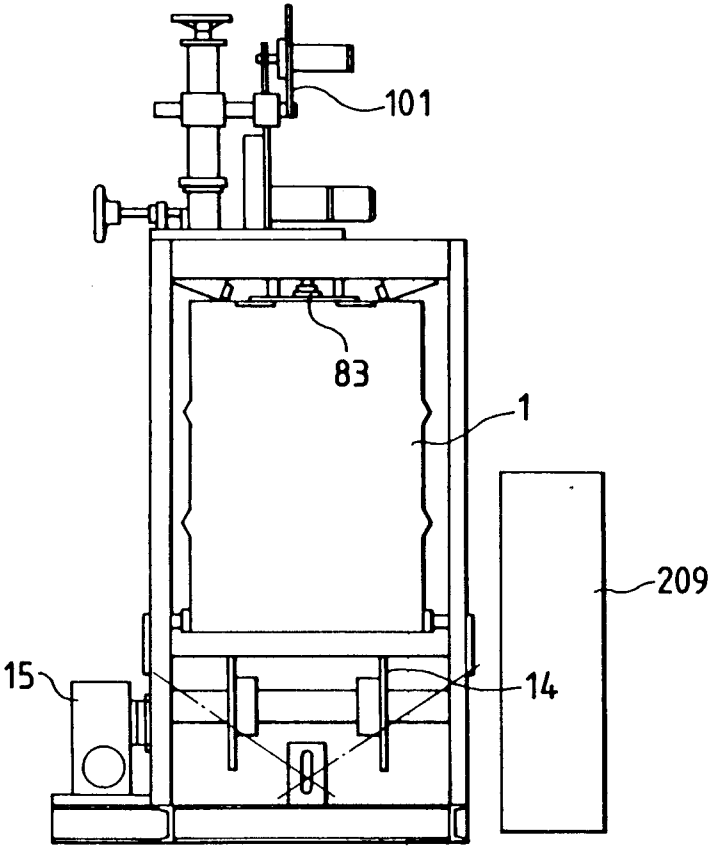

Signals from the drum sensor etc. on the apparatus just described are input into a control board 209 (see FIGS. 2 and 3). The air cylinders, motors, solenoid valves and some other devices are sequence-controlled by means of the operating signals issued from the control board 209.

Figure 16:
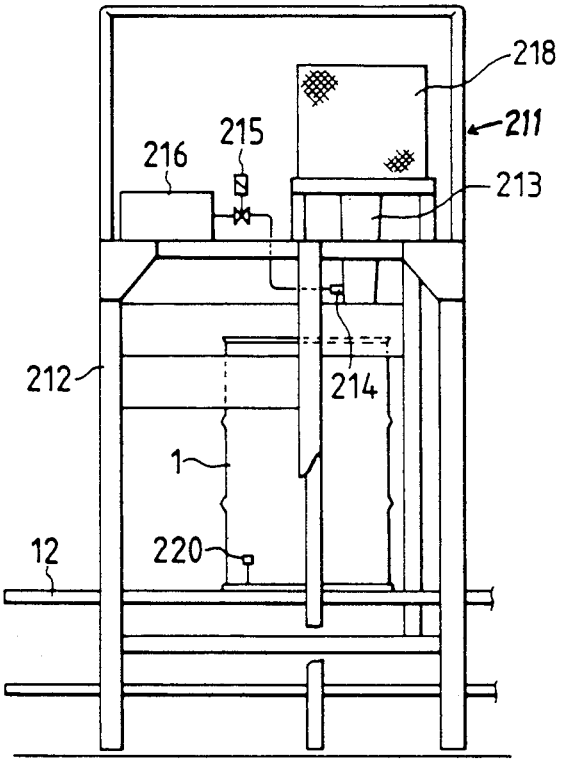
FIG. 16 is a front view showing another preferred embodiment of an automatic temporary cover remover.
Figure 17:
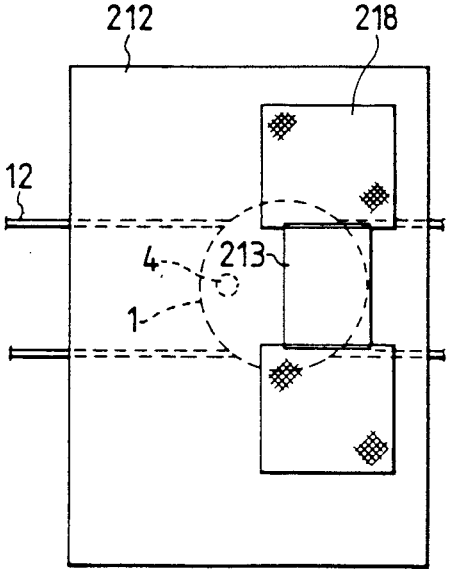
FIG. 17 is a plan view of the apparatus shown in FIG. 16.

This invention is by no means limited to the preferred embodiment described. If the adhesive strength of the temporary cover is not very great, for example, the temporary cover remover may be of a simpler design, as shown in FIGS. 16 and 17.

A temporary cover remover 211 is provided inside a housing 212 and equipped with a diffuser 213 having a nozzle 214 that opens near the lower end thereof. The nozzle 214 is connected to an air compressor 216 through a solenoid valve 215. The upper end of the diffuser 213 opens into a temporary cover recovery basket 218. When a drum 1 from the rough positioner (not shown) comes directly below the temporary cover remover 212, signals from an optical drum sensor 220 open the solenoid valve 215 to send a high-velocity stream of air through the nozzle into the diffuser 213. Sucking in the temporary covers 7 over the large spout 4 and small spout 5 as in the first preferred embodiment described previously, the diffuser 213 sends the removed covers 7 into the recovery basket 218. With this preferred embodiment, the opening at the lower end of the diffuser 213 is large enough to eliminate the need for the high-precision positioning of the drum 1. Furthermore, this simpler embodiment removes one temporary cover 7 at a time. That is, the temporary cover 7 over the large spout 4 is removed first, followed by the removal of the one over the small spout 5.

The temporary cover attaching and removing processes need not be fully automatic, but may be partially manual. The method and apparatus of this invention are applicable not only to drums but also to small cans, bottles and other types of containers having spouts or mouths. Provision may be made to temporarily cover the spouts or mouths of more than one container at a time. Containers may be fed either in the upright position or in the horizontal position. In the displacement preventing unit shown in FIG. 6, a pad raised and lowered by an air cylinder may be provided to hold fast the top plate of a drum from above.

What is claimed is:

1. A method of temporarily covering an opening of a container to prevent the entry of foreign matter during a process in which a plurality of containers are handled, comprising the steps of:

preparing a temporary cover, having a sticky surface on one side thereof, that is large enough to cover the opening of the container;

automatically feeding the container in such a manner that the opening of the container is positioned at a temporary covering point;

automatically feeding the temporary cover to a position near the opening of the container with the sticky surface thereof oriented to face the opening of the container; and automatically lightly pressing the temporary cover against the end of the opening so that the temporary cover sticks thereto.

2. A method of temporarily covering an opening of a container according to claim 1, in which an adhesive is applied in stripes on the sticky surface of the temporary cover.

3. A method of temporarily covering an opening of a container according to claim 1, in which the container being conveyed forward is moved and turned so that the opening thereof is positioned at the temporary covering point.

4. A method of temporarily covering an opening of a container according to claim 1, in which the container being conveyed forward is first moved so that the opening thereof is positioned approximately at the temporary covering point and then moved further so that the opening thereof is positioned exactly at the temporary covering point.

5. A method of temporarily covering an opening of a container according to claim 1, in which each of said plurality of containers is fed intermittently one after another.

6. A method of temporarily covering an opening of a container according to claim 1, in which, after a predetermined job is performed on the container, the container is automatically fed so that the opening thereof is positioned at the temporary cover removing point and then the temporary cover is removed from the end of the opening.

7. A method of temporarily covering an opening of a container according to claim 6, in which the container being conveyed forward is moved and turned so that the opening thereof is positioned at the temporary cover removing point.

8. A method of temporarily covering an opening of a container according to claim 6, in which the container being conveyed forward is first moved so that the opening thereof is positioned approximately at the temporary cover removing point and then moved further so that the opening thereof is positioned exactly at the temporary cover removing point.

9. A method of temporarily covering an opening of a container according to claim 6, in which each container is fed intermittently one after another.

10. A method of temporarily covering an opening of a container according to claim 6, in which a sucking disc connected to a vacuum pump draws the temporary cover away from the end of the opening.

11. A method of temporarily covering an opening of a container according to claim 6, in which a diffuser having a nozzle to direct a stream of compressed air to the tip thereof draws the temporary cover away from the end of the opening.

12. An apparatus for temporarily covering an opening of a container to prevent the entry of foreign matter during a process in which a plurality of containers are handled, comprising:

means for automatically conveying the container;

positioning means provided midway along the conveying means for detecting and stopping the container so that the opening thereof is positioned at a temporary covering point;

means for automatically feeding a temporary cover, having a sticky surface on one side thereof, that is large enough to cover the opening of the container to a position near the opening of the container at the temporary covering point with the sticky surface thereof being directed to face the opening of the container; and means, provided next to the temporary cover feeding means, for automatically lightly pressing the temporary cover against the end of the opening so that the temporary cover adheres thereto.

13. An apparatus for temporarily covering an opening of a container according to claim 12, wherein said conveying means comprises means for automatically conveying the plurality of containers intermittently along the longitudinally direction of conveyance.

14. An apparatus for temporarily covering an opening of a container according to claim 12, in which the conveying means is a chain conveyor.

15. An apparatus for temporarily covering an opening of a container according to claim 12, in which the positioning means comprises rough positioning means and fine positioning means.

16. An apparatus for temporarily covering an opening of a container according to claim 15, in which the rough positioning means comprises a first container sensor, a first container stopper actuated by signals from the first container sensor, first means for raising and for rotatably holding the container after it is brought to a standstill by the first container stopper above the conveying means, a container opening sensor, and means actuated by signals from the container opening sensor to turn and move the container to bring the opening thereof into the desired position, and the fine positioning means comprises a second container sensor, a second container stopper actuated by signals from the second container sensor, second means for raising and for rotatably holding the container after it is brought to a standstill by the second container stopper above the conveying means, means for holding the container opening at the temporary covering point, and means for turning and moving the container held by the container opening holding means to bring the opening thereof into the desired position.

17. An apparatus for temporarily covering an opening of a container according to claim 12, in which the temporary cover feed means comprises a base, a reel mounted on the base to carry a paper strip on which temporary covers are affixed at given intervals, a peel plate mounted on the base to peel the temporary cover away from the paper strip, the forward end of the peel plate being positioned near the opening of the container at the temporary covering point, a guide roll, a drive roll and a coiling roll mounted on the base, and a motor to drive the drive and coiling rolls such that the paper strip is paid out from the reel and taken up by the coiling roll through the guide roll, peel plate and drive roll; and the temporary cover pressing means comprises a fluid-actuated cylinder attached to the base, a vacuum grid connected to one end of the rod of the fluid-actuated cylinder, the vacuum grid being positioned near the forward end of the peel plate, and a vacuum pump connected to the vacuum grid for sucking the temporary cover detached from the paper strip onto the vacuum grid as the fluid-actuated cylinder pushes the vacuum grid toward the end of the opening of the container.

18. An apparatus for temporarily covering an opening of a container according to claim 17, in which the temporary cover pressing means also includes a roller positioned downstream of the vacuum grid for applying a light pressure against the temporary cover that has been attached to the end of the opening of the container.

19. An apparatus for temporarily covering an opening of a container according to claim 12, further comprising means for automatically removing the temporary cover from the end of the opening of the container.

20. An apparatus for temporarily covering an opening of a container according to claim 19, in which the temporary cover removing means comprises a housing, a fluid-actuated cylinder mounted above the housing in a position corresponding to the opening of the container, a sucking disc attached to one end of the rod of the fluid-actuated cylinder, a vacuum pump connected to the sucking disc through a solenoid valve, a diffuser, having a nozzle opening through a forward end thereof, mounted near the sucking disc, an air compressor connected to the nozzle through a solenoid valve, and a temporary cover recovery basket connected to the rear end of the diffuser.

21. An apparatus for temporarily covering an opening of a container according to claim 19, in which the temporary cover removing means comprises a housing, a diffuser, having a nozzle opening through a forward end thereof, mounted above the opening of the container in a position corresponding to the opening of the container, an air compressor connected to the nozzle through a solenoid valve, and a temporary cover recovery basket connected to the rear end of the diffuser.

22. A method of temporarily covering an opening of a container according to claim 1, wherein said steps of preparing a temporary cover, automatically feeding the container, automatically feeding the temporary cover, and automatically lightly pressing the temporary cover against the end of the opening, are automatically repeated sequentially for each of the pluality of containers.

23. A method of temporarily covering an opening of a container according to claim 1, wherein said step of preparing a temporary cover comprises preparing a paper strip with a plurality of label-like temporary covers removably affixed longitudinally therealong; and said step of automatically feeding the temporary cover comprises paying out said paper strip with said temporary covers affixed thereto and peeling one of said temporary covers therefrom.

* * * * *